US011572725B2

(12) United States Patent
Held

(10) Patent No.: US 11,572,725 B2
(45) Date of Patent: Feb. 7, 2023

(54) SHUTTER FOR FURNITURE

(71) Applicant: Wolfgang Held, Hard (AT)

(72) Inventor: Wolfgang Held, Hard (AT)

( * ) Notice: Subject to any disclaimer, the term of this patent is extended or adjusted under 35 U.S.C. 154(b) by 295 days.

(21) Appl. No.: 16/769,252

(22) PCT Filed: Dec. 5, 2018

(86) PCT No.: PCT/EP2018/083646
§ 371 (c)(1),
(2) Date: Jun. 3, 2020

(87) PCT Pub. No.: WO2019/110660
PCT Pub. Date: Jun. 13, 2019

(65) Prior Publication Data

US 2021/0180379 A1 Jun. 17, 2021

(30) Foreign Application Priority Data

Dec. 8, 2017 (EP) ..... 17206261

(51) Int. Cl.

| | |
|---|---|
| ***E05D 15/10*** | (2006.01) |
| ***E05D 15/48*** | (2006.01) |
| ***E05D 15/58*** | (2006.01) |
| ***E05D 15/56*** | (2006.01) |

(52) U.S. Cl.
CPC ..... *E05D 15/1021* (2013.01); *E05D 15/48* (2013.01); *E05D 15/56* (2013.01); *E05D 15/58* (2013.01); *E05D 2015/485* (2013.01); *E05Y 2900/20* (2013.01)

(58) Field of Classification Search
CPC ..... E05D 15/1021; E05D 15/48; E05D 15/56; E05D 15/58; E05D 15/10; E05D 2015/485; E05D 2015/585; E05Y 2900/20; E05Y 2900/132; E05Y 2800/122; E06B 3/5045; E06B 3/5054; E06B 3/48; E06B 3/922; E05F 17/004; E05F 2017/005; E05F 2017/007; Y10T 16/373; Y10T 16/387
USPC ..... 312/298; 16/94 R, 87 B
See application file for complete search history.

(56) References Cited

U.S. PATENT DOCUMENTS

| | | | | |
|---|---|---|---|---|
| 10,280,678 | B1 * | 5/2019 | Rendon, Jr. | E05D 15/54 |
| 10,337,228 | B1 * | 7/2019 | Matthews | E06B 3/5072 |
| 10,907,400 | B2 * | 2/2021 | Christenson | E06B 3/5045 |
| 2002/0163284 | A1 * | 11/2002 | Levy | E05D 15/58 312/302 |
| 2004/0100171 | A1 * | 5/2004 | Brown | E06B 3/5045 312/322 |

(Continued)

*Primary Examiner* — William L Miller
(74) *Attorney, Agent, or Firm* — John Alumit

(57) ABSTRACT

The invention relates to a shutter for furniture, cabinets, shelf units and the like, having at least two shutter parts which are arranged next to one another, which shutter parts can be pivoted on the furniture carcass about an axis of rotation, can be transferred by means of an inner guide from a common plane into two mutually parallel planes and can then be slid over one another, wherein the first shutter part, which is furthest away from the axis of rotation, interacts with the second shutter part, which is closer to the axis of rotation, by way of at least two guide means arranged on inner sides thereof, and wherein an outward thrusting mechanism interacts with the first shutter part, wherein the outward thrusting mechanism can be moved from an inoperative position into an operative position.

12 Claims, 10 Drawing Sheets

(56) References Cited

U.S. PATENT DOCUMENTS

Figure 1A:
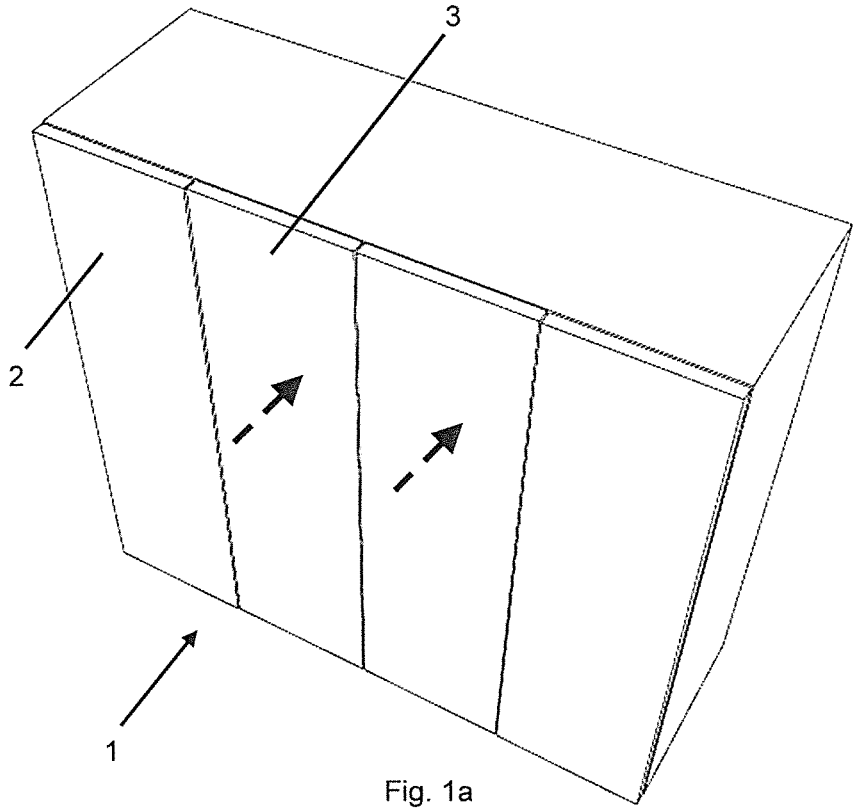

| | | | | |
|---|---|---|---|---|
| 2006/0197357 | A1* | 9/2006 | Catania | E05D 15/58 296/155 |
| 2010/0242366 | A1* | 9/2010 | Liebscher | E05F 15/643 49/142 |
| 2017/0275937 | A1 | 9/2017 | Park | |
| 2019/0301218 | A1* | 10/2019 | Rupp | E05F 1/08 |
| 2021/0396057 | A1* | 12/2021 | Spork | E05D 15/26 |

* cited by examiner

SHUTTER FOR FURNITURE

BACKGROUND

The invention relates to a shutter for furniture as defined by the preamble to claim 1.

In conventional shutters, for instance with a rotation mechanism, the furniture cannot only be opened partially, for instance in order to take out items that are needed more often. The shutter must either remain completely open or must be opened and closed again repeatedly. Precisely when space is tight for the furniture, it is often hard for the user to open the shutter completely as needed. Also, especially in tall cabinets, it is not always possible to use other mechanisms, such as opening out the shutter upward. Mechanisms such as sliding shutters or shutters with a rotary/sliding mechanism can either not be opened completely, or as a rule have a complex mechanism, which additionally requires accurate adjustment.

From DE 2 831 128 A1, a furniture item is known that has a door that is formed by a series of uniformly dimensioned panels, which are movable from a closed position, in which they are coplanar to one another, to an open position, in which they are folded parallel and on one side of the furniture. The panels are connected to one another by means of a parallelogram connection system, which makes it possible to move the panels from the closed position to the open position using a single control element. The panels slide in an upper and lower guide of the piece of furniture and lie against one side of the furniture, making access to the contents of the piece of furniture possible. The connection system is clearly visible on the top and underside of the panels, and the piece of furniture cannot be opened all the way.

DE 3 619 775 A1 describes a sliding door cabinet in which, in addition to fixed front doors, frontally sliding front doors are also provided. In the closed position of the doors, the doors are initially flush on the front side of the cabinet, but things are initially pulled out frontally and then the sliding front doors are slid laterally at the same time as the fixed front doors are moved, it becomes possible to open the cabinet. The doors are movably supported by means of rollers on rails, which are located at an upper and lower region of the cabinet body. The mechanics of the door-opening mechanism is relatively complicated and is also visible on the top and undersides of the doors. Here again, complete opening of the cabinet is not possible.

In DE 20 2005 007 214 U1, a cabinet is described which has at least two door elements which, in the closed state, are located in the same plane and can be moved relative to one another in at least one guide rail. Spaced-apart retaining elements are located on at least one door element and are connected to one another and embodied in such a way that when a door element in the course being opened is moved in the guide rail, this door element necessarily swings, parallel to the guide rail, behind the other door element and can be slid behind that element. As in all the classical sliding doors, it is not possible to open the cabinet all the way.

From U.S. Pat. No. 2,002,163 284 A1, a container structure is known which has an internal storage compartment and an opening for access to the storage compartment. A slide plate and a pivotable plate serve to cover and uncover the opening. The pivotable plate can be slid between the closed position, which covers a second portion of the opening next to the first portion, and an open position. The slide plate can be slid between a closed position, which covers a second portion of the opening next to the first portion, and an intermediate opening position, which is located in an overlapping relation to the pivot plate when the pivot plate is in its closed position, in order to enable access to the compartment through the second portion. The slide plate, in the intermediate opening position, is pivotable together with the pivot plate into a fully opened position, in order to enable access to both the first and the second portions of the opening. The profile element in which the slide plate is displaceably supported is located visibly on the top and underside of the pivotable plate.

It is therefore the object of the present invention to develop a shutter for furniture, cabinets, shelving units or the like, which have an internal guide, and in which a shutter of a piece of furniture can be either partially or fully opened and does not have the disadvantages of the prior art.

SUMMARY

This object is attained by the features of claim 1. The first shutter part, farthest away from the axis of rotation, cooperates with the second shutter part, located closer to the axis of rotation, by means of at least two guide means of the inner guide that are located on the insides of the shutter parts; an outward thrusting mechanism cooperates with the first shutter part, and the outward thrusting mechanism is movable from a position of repose to an operative position, and by means of the outward thrusting mechanism the first shutter is movable into the parallel plane, and then the first shutter part can be slid over the second shutter part by means of the guide means, and the outward thrusting mechanism and the guide means are connected at least partially with a covering on their inner sides that can be oriented toward the furniture carcass, and are thus coverable.

The shutter, as compared to the prior art, has the advantages that it allows opening of the furniture in the middle, without opening out the shutter or shutters. Thus for instance items which one needs more often than others can be located in the middle of the furniture, and the furniture can either remain half-open or only half-opened and then closed again. This furniture can furthermore be opened with a shutter that is quasi-half-size, which makes it possible to open the furniture completely, even when little space is available for the furniture. This is of interest precisely with tall cabinets, which cannot possibly be opened upward. The mechanism is comparatively simple to produce and install and does not require complex adjustment or ongoing maintenance.

Further improvements arise from the features of the dependent claims. A first embodiment of the invention, which is advantageous for production and function, provides that the guide means consists of an inner guide rail.

A second advantageous embodiment of the invention that is advantageous for use and function provides that in the position of repose of the outward thrusting mechanism, the shutter parts are locked by a first and second latching mechanism in their positions located next to one another; in the operative position of the outward thrusting mechanism, the shutter parts are held fixed in their parallel planes by the first latching mechanism, and/or the shutter parts are displaceable relative to one another in their positions by the second latching mechanism.

A third embodiment of the invention that is advantageous in terms of use and function provides that the outward thrusting mechanism is located between the guide means farthest apart from one another, on their end remote from the axis of rotation; the first shutter part or the outward thrusting mechanism has an outward thrusting mechanism which cooperates with the covering, and/or the outward thrusting mechanism keeps the outward thrusting mechanism in the position of repose or enables a motion into the operative position.

A fourth embodiment of the invention that is advantageous in terms of use and function provides that the outward thrusting mechanism operates in spring-loaded fashion; the outward thrusting mechanism can be locked at the covering and/or is braced thereon.

A fifth embodiment of the invention, which is advantageous in terms of both manufacture and function, provides that the outward thrusting mechanism has a latchable inward/outward movement mechanism.

A sixth embodiment of the invention, advantageous function, provides that the outward thrusting mechanism has a connecting rail, which on at least one of its ends extends as far as the guide means, and which cooperates with at least two connecting parts that are movable in parallelogram-like fashion; the first corners of the connecting parts located opposite one another are connected to the first connecting part and to the covering, and the opposed second corners of the connecting parts are connected to the connecting rail movably, and in the position of repose of the outward thrusting mechanism, the connecting parts have two obtuse angles and two acute angles, and the first corners have the obtuse angles, and in the operative position of the outward thrusting mechanism, the pairs of angles each occupy the respective other angular position.

A seventh embodiment of the invention that is advantageous in terms of its function provides that the guide means is in at least three parts, and the parts are connected to one another in such a way that they can be pulled out. The part located closest to the axis of rotation is connected to the second shutter part, and the part farthest away from the axis of rotation is connected to the covering. At least one locking bar is connected to the part that is farthest away from the axis of rotation, and/or the covering is connected via two oblong holes, which are located parallel to the guide means and/or to the covering and are inclined in their path on the respective end of the locking bar, and via two bolts, which are located on the farthest-away part and/or the covering and which engage the oblong slots.

An eighth embodiment of the invention that is advantageous in terms of both usage and function provides that, when there are shutter parts located side by side, the end of the locking bar farthest away from the axis of rotation is located next to the end of the connecting rail extending as far as the guide means. The end of the locking bar located closest to the axis of rotation has a region that is at an angle of 90° and protrudes past the locking bar. That end, with this protruding region, engages a locking element located on the inner side of the second shutter. By the motion of the outward thrusting mechanism out of the inoperative position into the operative position and the ensuing sliding of the first shutter part over the second shutter part, first one end of the connecting rail is moved behind the end of the locking bar located farthest away from the axis of rotation, and by means of the movement of the bolts into the oblong slots, the angled region is moved out of the locking element, and at the end of the slidability of the first shutter part, the end of the locking bar located closest to the axis of rotation is locked by a guiding terminal-position keeper.

A ninth embodiment of the invention, which is advantageous in terms of production and function, provides that the guiding terminal-position keeper is based on a magnetic and/or mechanical principle of operation.

DRAWINGS

Figure 1B:
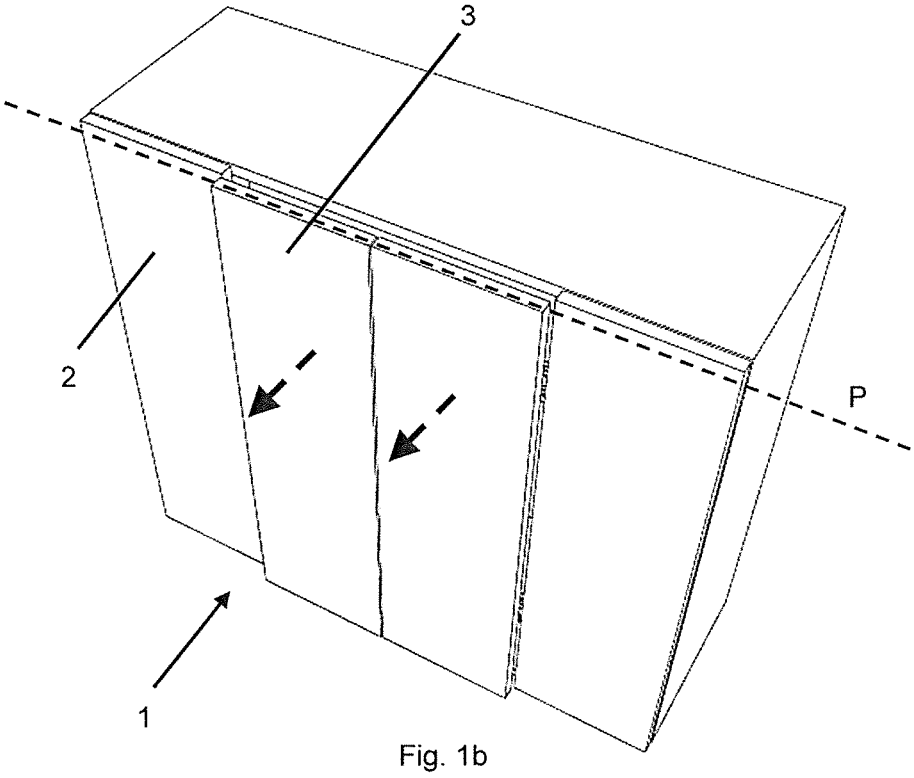
Figure 2A:
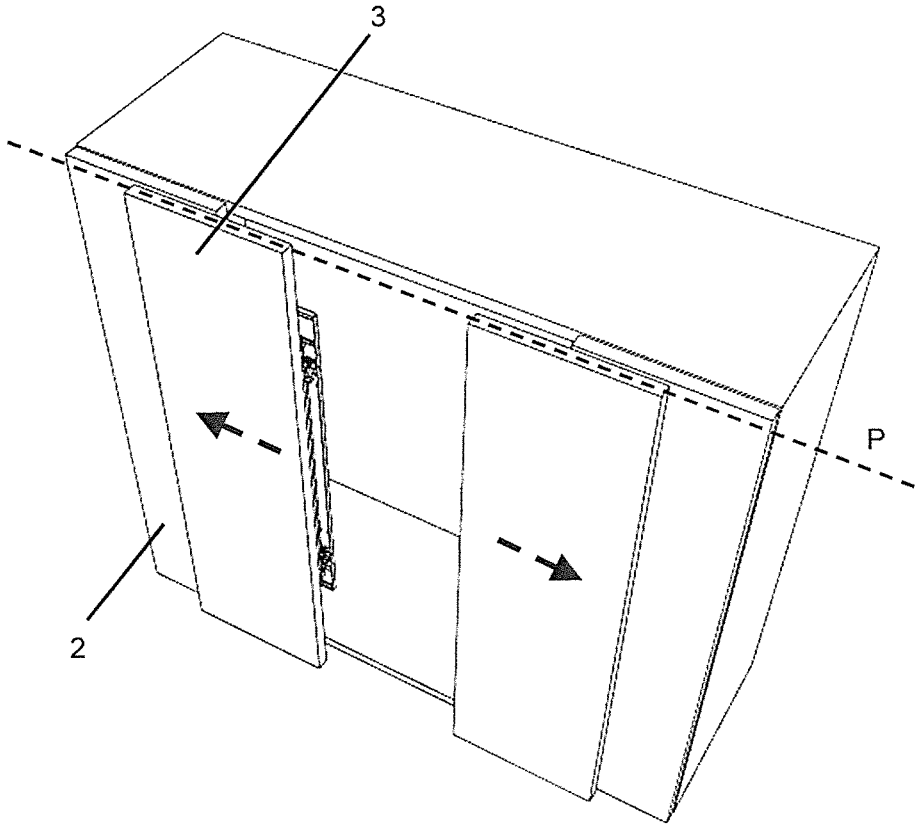
Figure 2B:
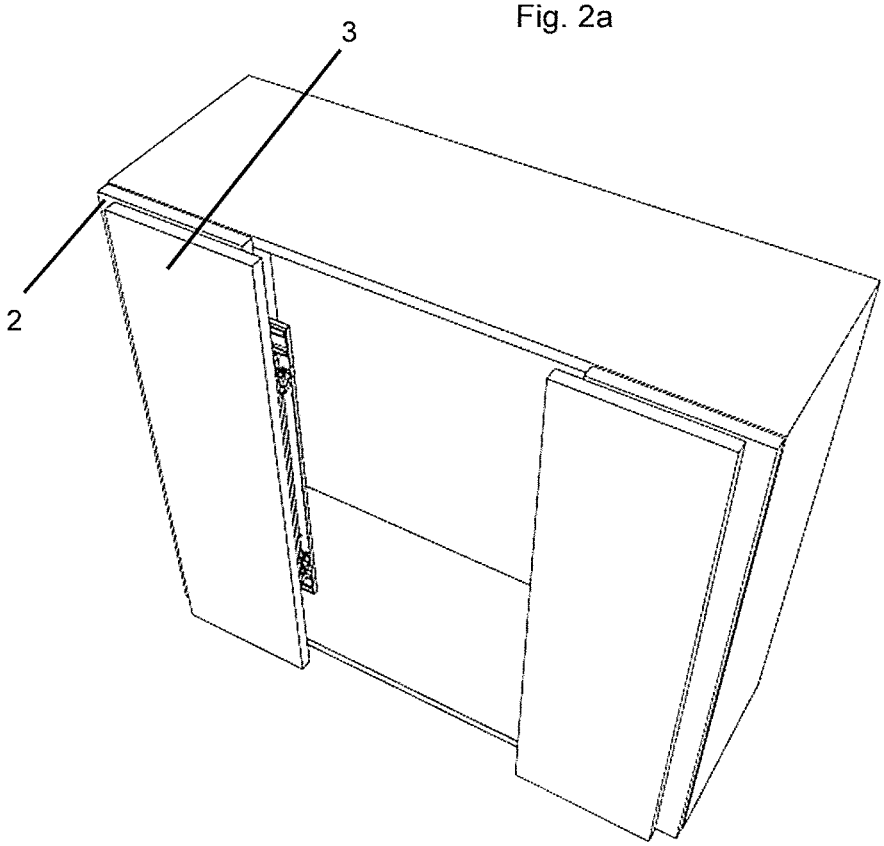
Figure 3A:
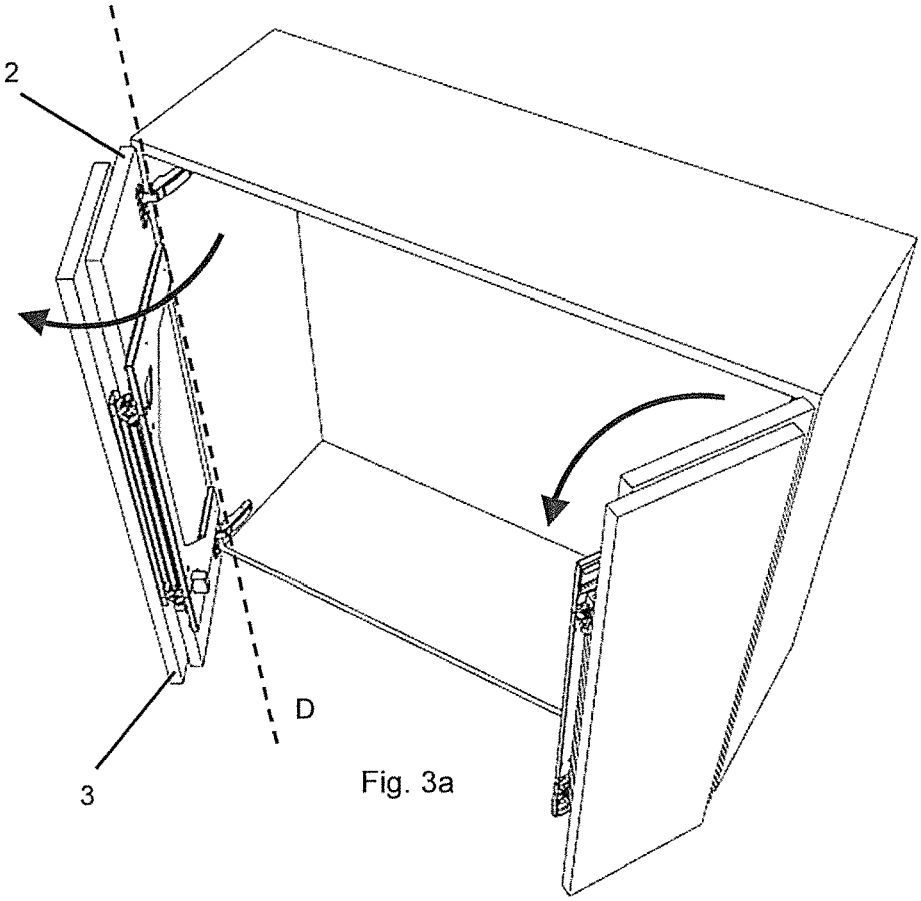
Figure 3B:
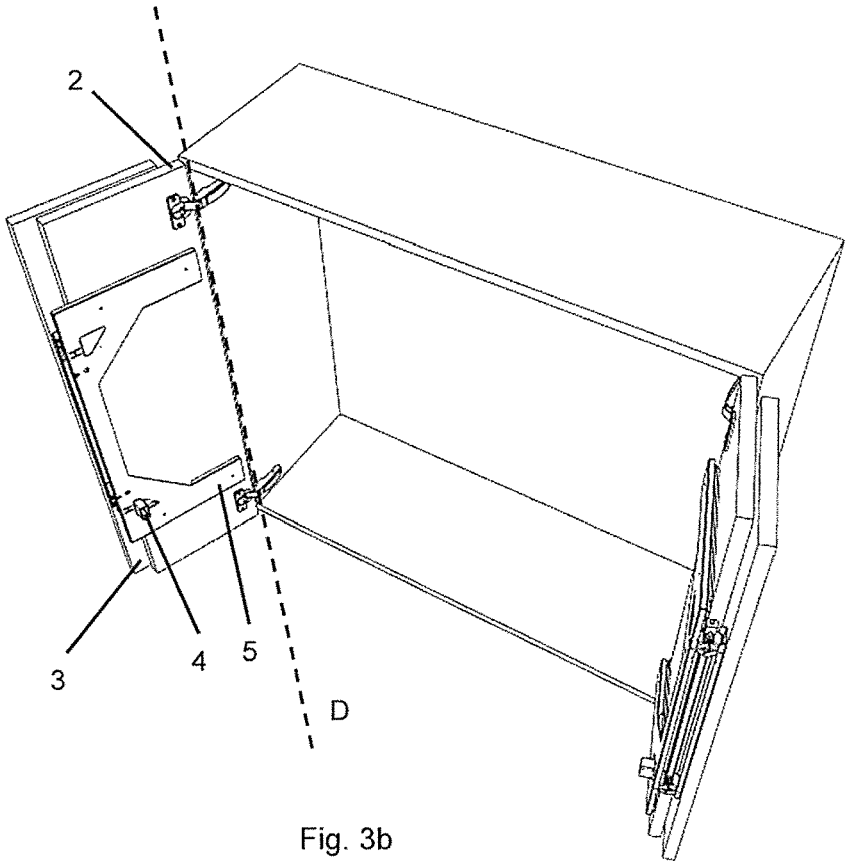
Figure 4A:
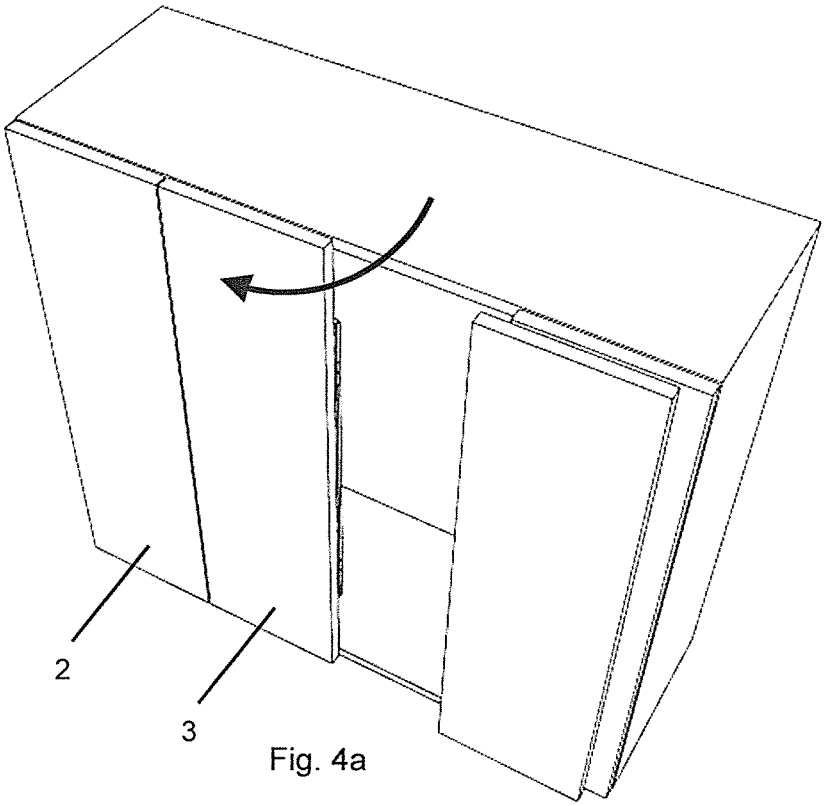
Figure 4B:
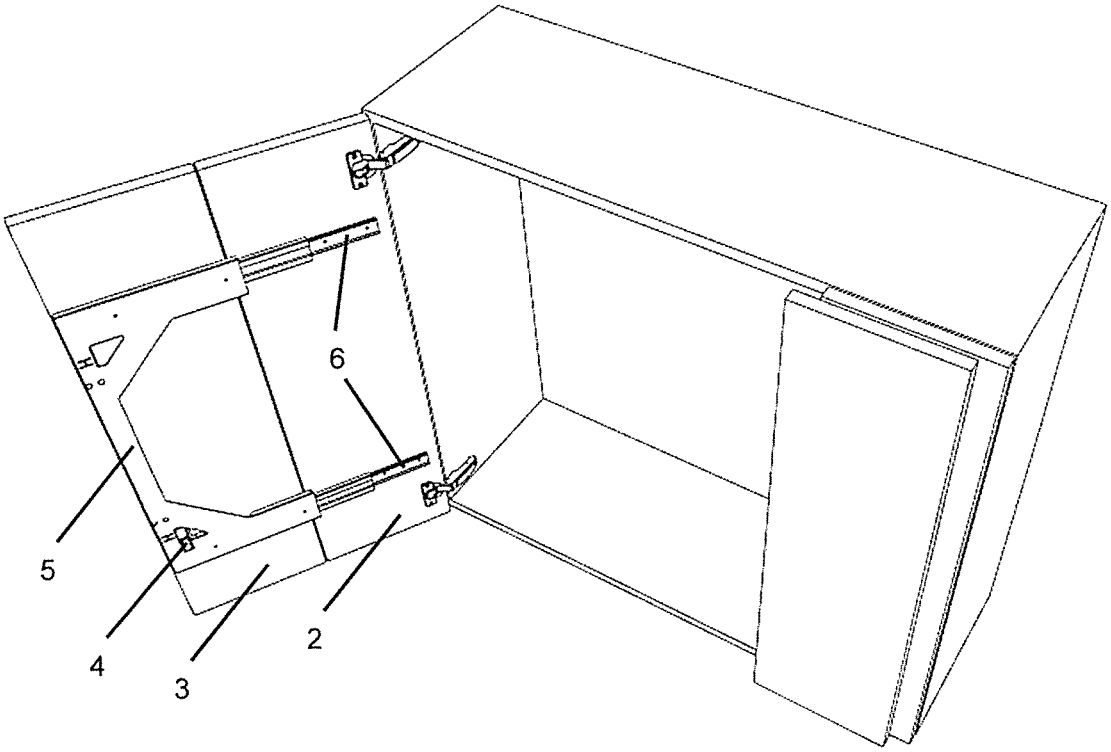
Figure 5A:
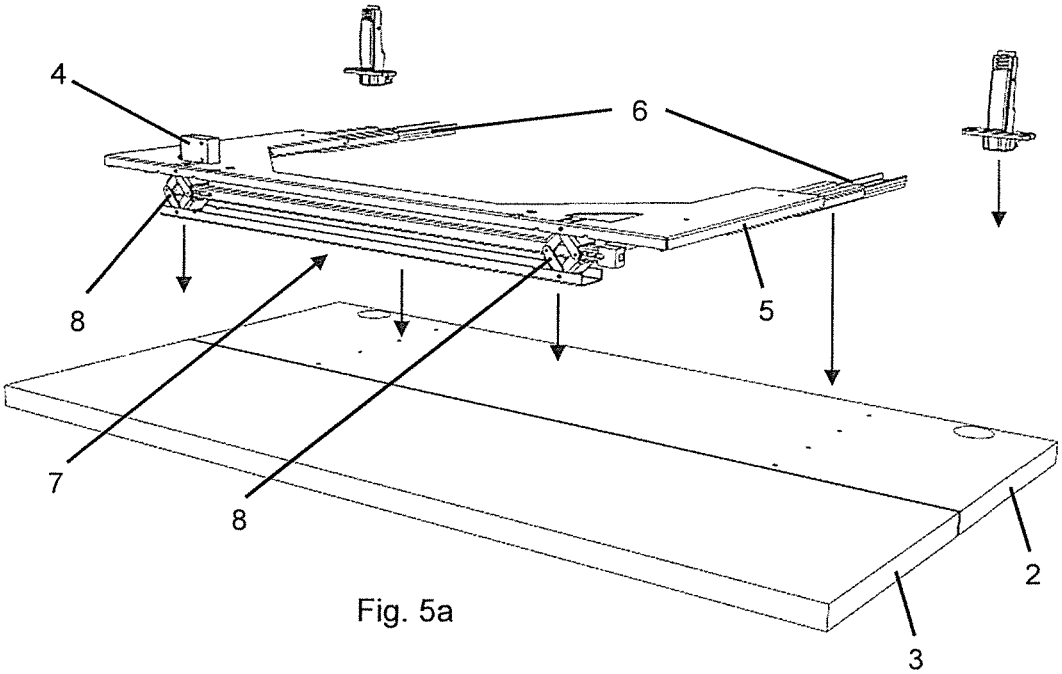
Figure 5B:
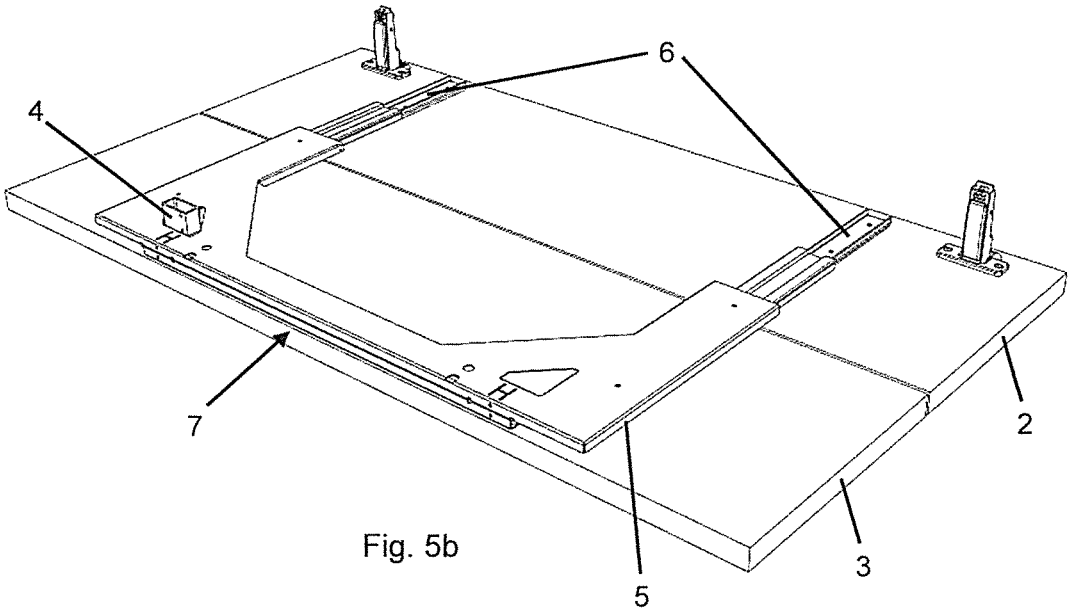
Figure 6:
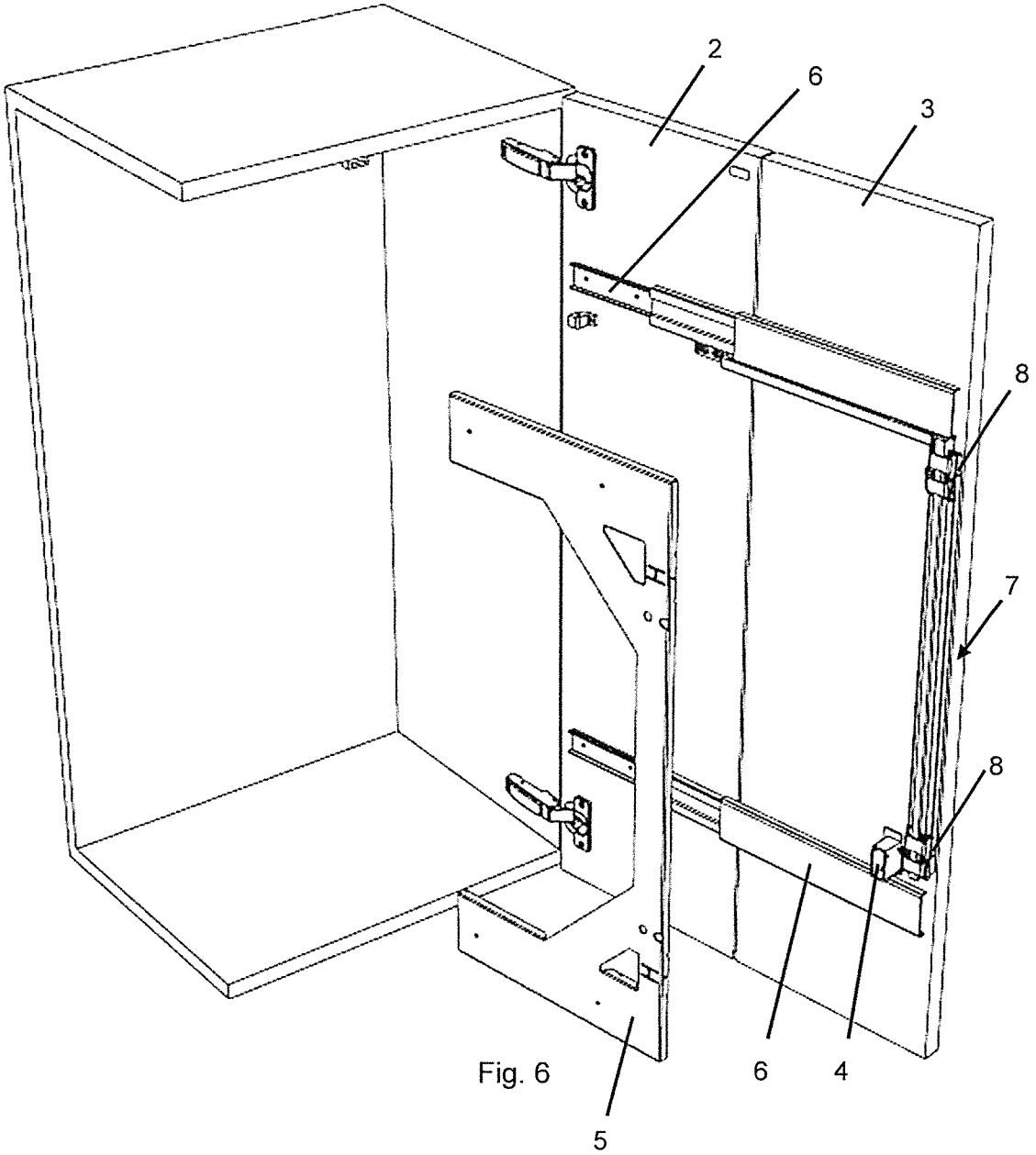
Figure 7A:
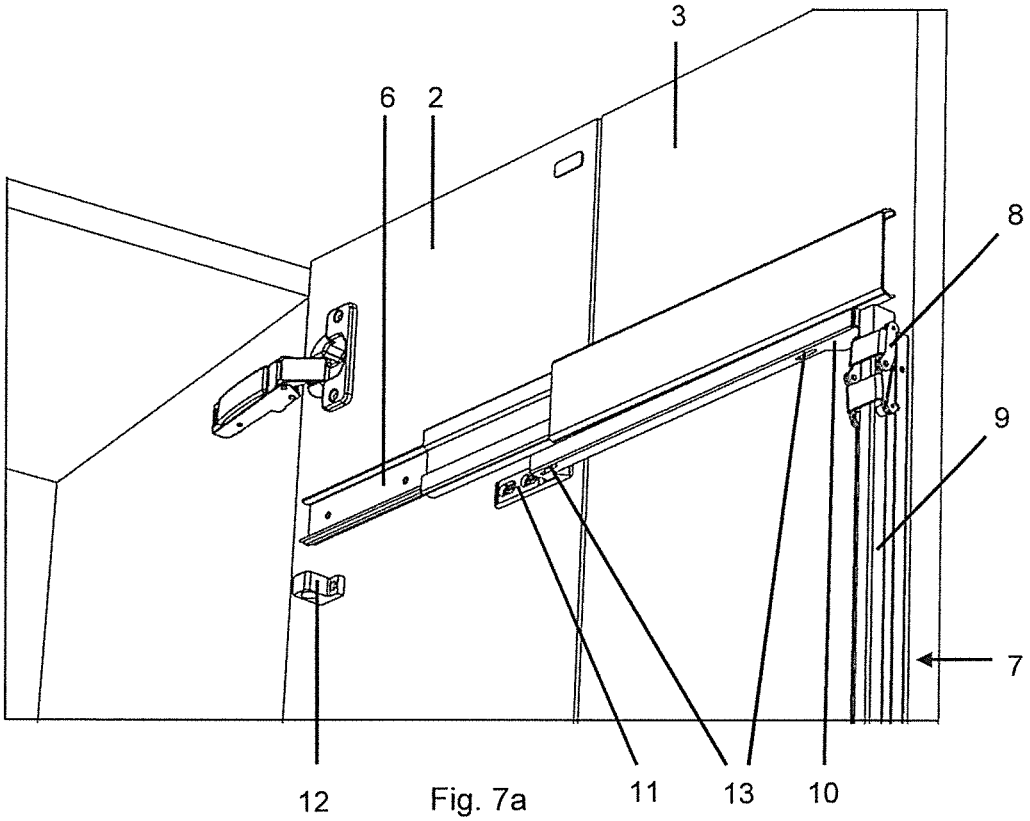
Figure 7B:
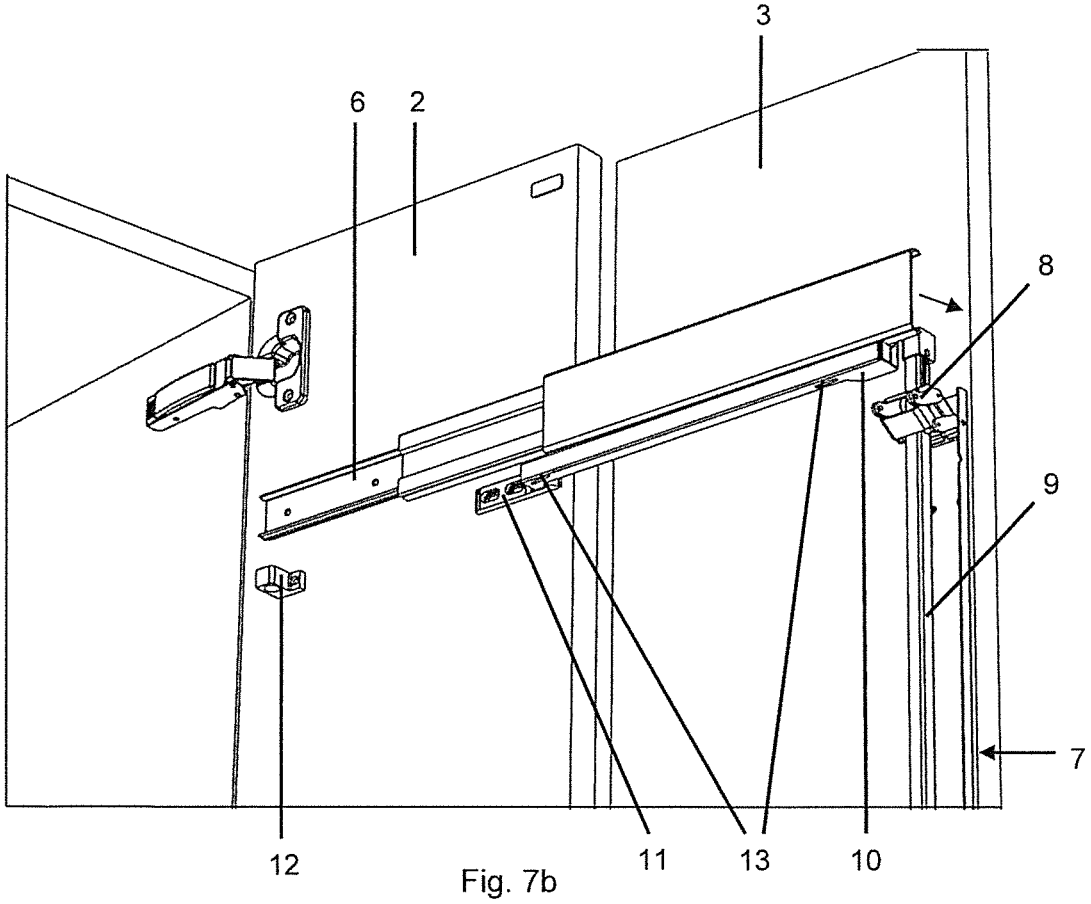
Figure 8A:
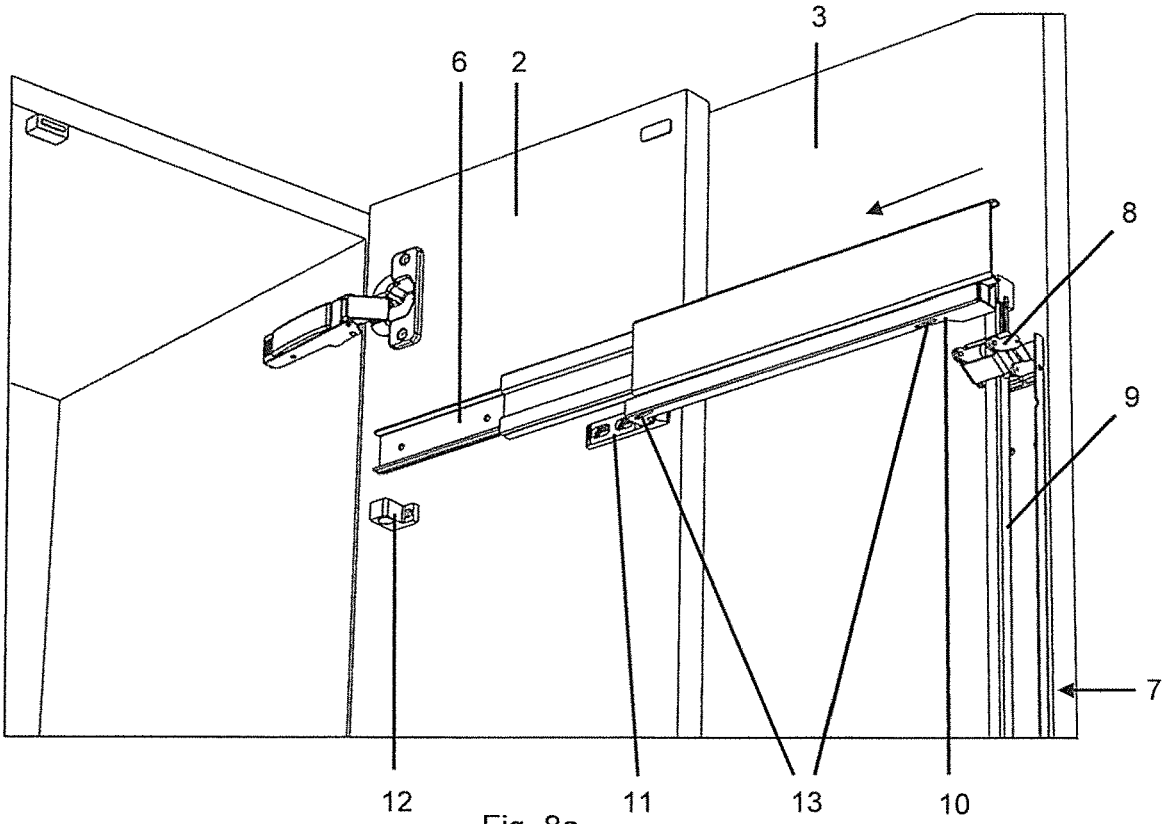
Figure 8B:
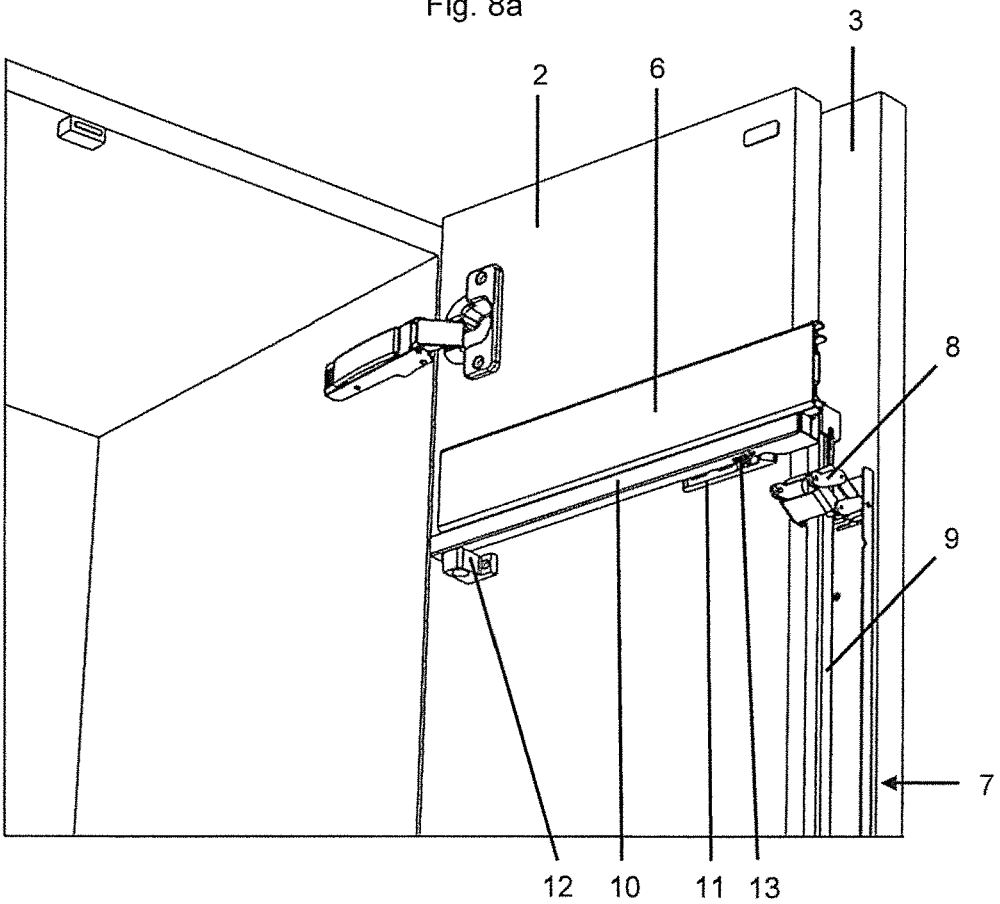
Figure 9A:
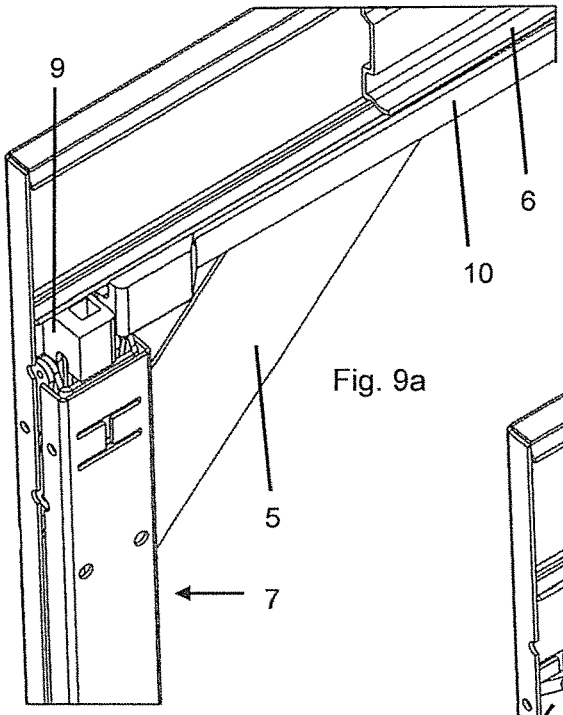
Figure 9B:
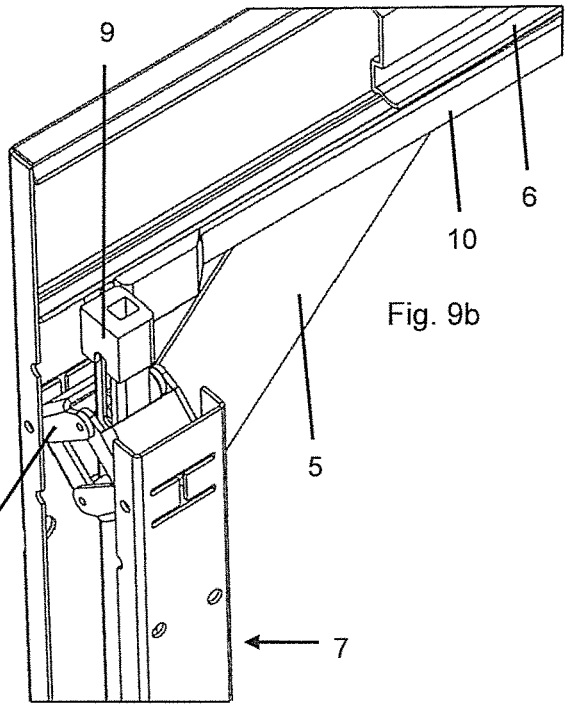
Figure 9C:
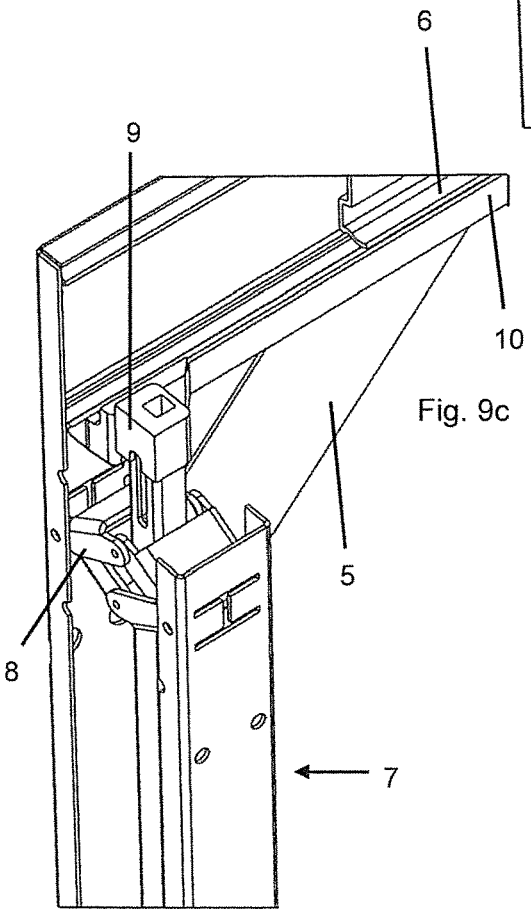
Figure 10A:
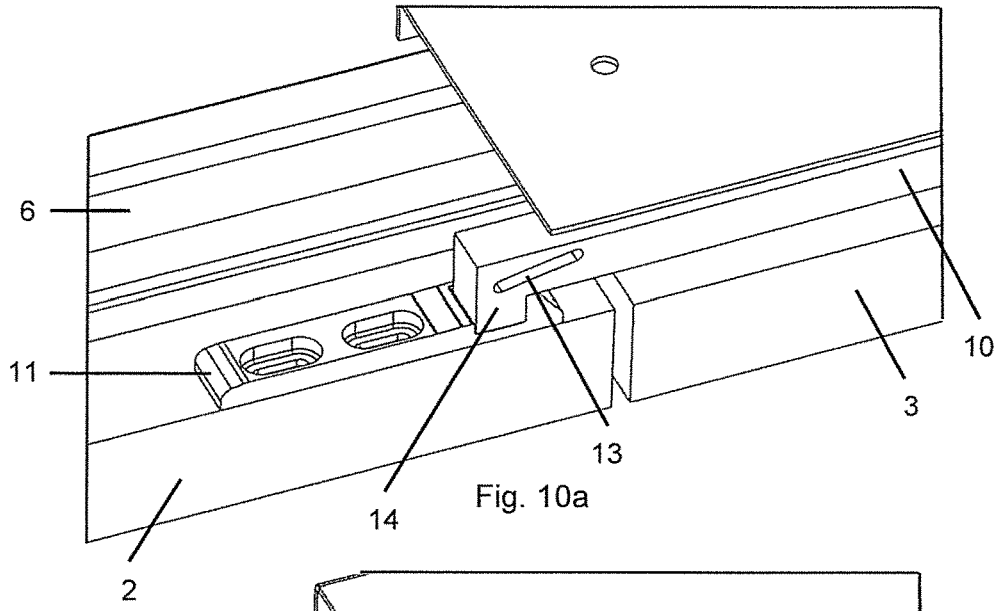
Figure 10B:
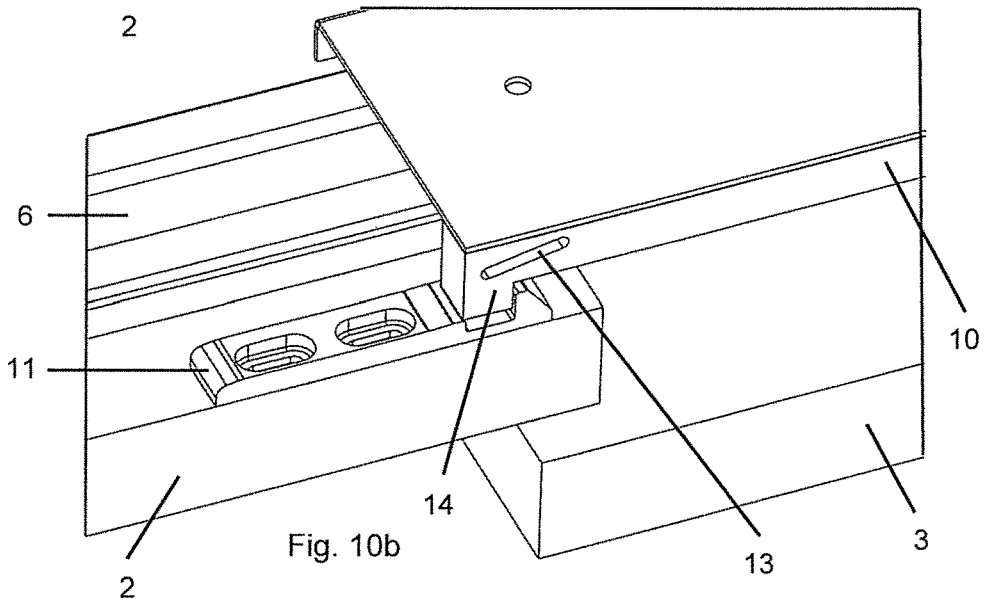
Figure 10C:
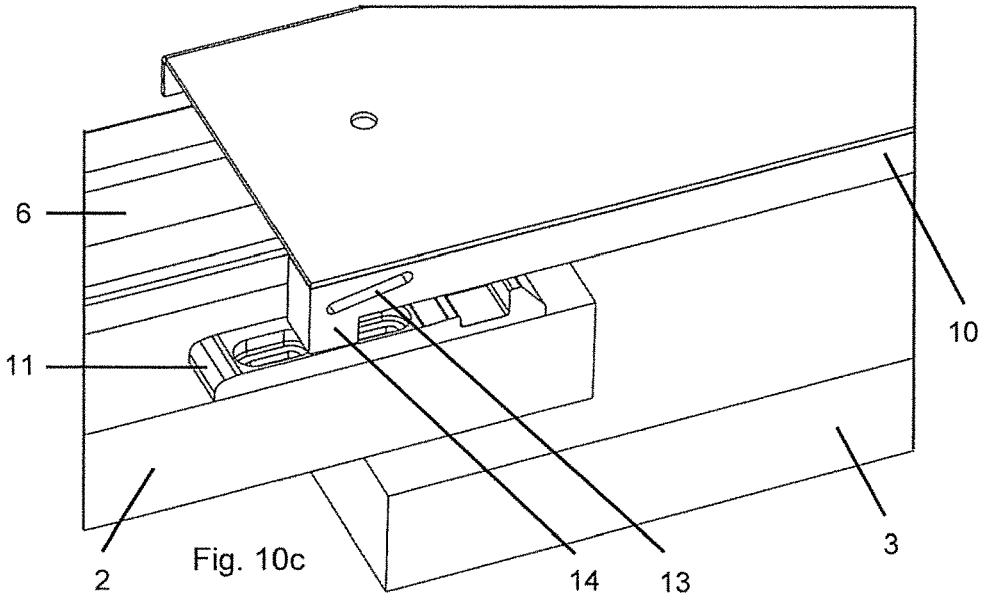

The invention will now be described in further detail in conjunction with an exemplary embodiment. In the drawings:

FIG. 1*a*, a perspective view of a cabinet with closed cabinet shutters;

FIG. 1*b*, a perspective of a cabinet with cabinet shutters thrust outward halfway;

FIG. 2*a*, a perspective view of a cabinet with cabinet shutters slid halfway over;

FIG. 2*b*, a perspective view of a cabinet with cabinet shutters slid all the way over;

FIG. 3*a*, a perspective view of a cabinet with cabinet shutters slid all the way over and swung halfway open;

FIG. 3*b*, a perspective view of a cabinet with cabinet shutters slid all the way over and swung open;

FIG. 4*a*, a perspective view of a cabinet with cabinet shutters slid halfway over and closed;

FIG. 4*b*, a perspective view of a cabinet with the cabinet shutter slid halfway over and fully swung open;

FIG. 5*a*, a perspective view of a two-part cabinet shutter and of an inner guide not connected to it;

FIG. 5*b*, a perspective view of a second cabinet shutter and an inner guide connected to it;

FIG. 6, a perspective view of a two-part cabinet shutter and of an inner guide connected to it, with the covering taken off;

FIG. 7*a*, a perspective partial view of a two-part cabinet shutter in the swung-open but not thrust outward;

FIG. 7*b*, a perspective partial view of a two-part cabinet shutter in the swung-open and thrust-outward state;

FIG. 8*a*, a perspective partial view of a two-part cabinet shutter in the swung-open and thrust-outward state, at the beginning of the sliding-over procedure;

FIG. 8*b*, a perspective partial view of a two-part cabinet shutter in the swung-open, thrust-outward and slid-over state;

FIG. 9*a*, a perspective partial view on the back side of a covering with a locking bar and outward thrusting mechanism, in the non-thrust-outward state of the cabinet shutter;

FIG. 9*b*, the perspective partial view of FIG. 9*a* in the thrust-outward state of the cabinet shutter;

FIG. 9*c*, the perspective partial view of FIG. 9*a* at the beginning of the sliding-over procedure;

FIG. 10*a*, a perspective partial view of the back side of the two-part cabinet shutter with a locking bar and locking element in the non-thrust-outward state of the shutter;

FIG. 10*b*, the perspective partial view of FIG. 10*a* in the ejected state of the cabinet shutter; and FIG. 10*c*, the perspective partial view of FIG. 10*a* at the beginning of the sliding-over procedure.

DETAILED DESCRIPTION

The perspective view of a cabinet shown in FIG. 1*a* shows a cabinet shutter 1 split in two or in two parts, in the closed state. It is possible to open the cabinet at least partially by pressing on a first shutter part 3, as a result of which that shutter part is moved frontally outward in a plane P parallel to the second shutter part 2, as FIG. 1*b* shows. The second shutter part 2 then remains in its closed position. After the first shutter part 3 has been moved outward, it can be slid outward, over the second shutter part 2, as a result of which an opening in the middle of the cabinet becomes visible. FIGS. 2*a* and 2*b* illustrate this procedure.

As can be seen in FIGS. 3*a* and 3*b*, a full opening of the cabinet is possible by an ensuing rotation of the second shutter part 2 about an axis of rotation D relative to the cabinet. The procedure of sliding and rotating the shutter parts 3 and 2 can also take place in reverse order. Naturally, it is also possible, instead of the two-sided opening shown, to open only one side of the cabinet by the above-described mechanisms, or to perform only sliding of the first shutter part 3, or only a rotation of the second shutter part 2, without first sliding the first shutter part 3. FIGS. 4*a* and 4*b* illustrate this.

In FIG. 4*b*, the inner guide of the first shutter part 3 on the second shutter part 2 can be seen. Here, two guide means 6, embodied as inner guide rails 6, are secured to the inner side of the second shutter part 2, and the inner guide rails 6 are at least partially covered by a covering 5. With the aid of a spring-loaded outward thrusting mechanism 4, the first shutter part 3 can be moved into the parallel plane P.

FIG. 5*a* shows the shutter parts 2 and 3 located next to one another and the inner guide rails 6 that are not connected to the shutter parts. An outward thrusting mechanism 7 is located between the inner guide rails 6, on their end remote from the axis of rotation D. The outward thrusting mechanism 7 can be connected to the covering 5 via first corners of two parallelogram-like movable connecting parts 8, which covers the connecting parts completely. The first shutter part 3 or the outward thrusting mechanism 7 have the outward thrusting mechanism 4, which cooperates with the covering 5. FIG. 5*b* shows the shutter parts 2 and 3, the outward thrusting mechanism 4, the covering 5, and the inner guide rails 6 in the state in which they are connected to one another.

FIG. 6 shows the shutter parts 2 and 3 secured to the cabinet carcass and located next to one another, inner guide rails 6 that are connected to the shutter parts and that can each be pulled out in three parts, the outward thrusting mechanism 7, and the connecting parts 8, which are now connected to the first shutter part 3 by their first corners facing away from the covering. What can also be seen is the outward thrusting mechanism 4, connected either to the first shutter part 3 or the outward thrusting mechanism 7, and the unmounted covering 5. The part of the inner guide rail 6 located closest to the axis of rotation D is connected here to the second shutter part 2, and the part of the inner guide rail 6 that is farthest away from the axis of rotation D is connected to the covering 5.

FIG. 7*a* shows further details of the inner guide, with the covering 5 not shown. In addition to the shutter parts 2 and 3, the inner guide rails 6, the outward thrusting mechanism 7 and connecting parts 8, a connecting rail 9 is shown as a component of the outward thrusting mechanism 7; this rail serves both as a connecting member for the connecting parts 8 located movably thereon and as a latching mechanism. In this position of the connecting parts 8, the legs of the first corners of the connecting parts 8, which are connected to the first shutter part 3 and the covering 5, respectively, have obtuse angles. The two other legs of the two corners, which are connected movably to the connecting rail, have acute angles. Also shown are a locking bar 10 and a locking element 11 connected to the second shutter part 2 as well as a guiding terminal-position keeper 12. The locking bar 10 has inclined oblong slots 13 on its two ends, parallel to the inner guide rail 6 and/or covering 5. If the shutter parts 2 and 3 are located next to one another, one end of the connecting rail 9 is located next to a first end, farthest away from the axis of rotation D, of the locking bar 10; these are parts of a first latching mechanism. Two bolts, which are located on the part of the inner guide rail 6 and/or of the covering 5 farthest away from the axis of rotation D, engage the oblong slots 13 and are located on the ends, remote from the axis of rotation D, of the oblong slots 13. Since the inclined paths of the oblong slots 13 at this location are located in the direction of the side of the locking bar 10 oriented toward the covering 5, the locking bar 10 is moved in the direction of the shutter parts 2 and 3, and a second end of the locking bar 10 engages a locking element 11 secured to the inside of the second shutter part 2, which are parts of a second latching mechanism. The combination of the first and second latching mechanism prevents sliding of the first shutter part 3 relative to the second shutter part 2. As is known from FIG. 1*a* and shown in FIG. 7*b*, the outward thrusting mechanism 4 is actuated by pressure on the outside of the first shutter part 3; this outward thrusting mechanism can be locked on the covering 5 and/or is braced thereon and can assume a state that is lockable and is either swung closed or open. Since the outward thrusting mechanism 4 is spring-loaded and is connected to the outward thrusting mechanism 7, the latter is now actuated by means of the spring force, as a result of which the outward thrusting mechanism 7 moves to its operative position, and the first shutter part 3 assumes a position relative to the second shutter part 2 that is offset into a parallel plane. The end of the connecting rail 9 located, in a position of repose of the outward thrusting mechanism 7, beside the first end of the locking bar 10 is thereby moved behind the locking bar 10. As a result, an initial sliding of the first shutter part 3 over the second shutter part 2 is made possible. In this position of the connecting parts 8, the legs of the first corners of the connecting parts 8, which are connected to the first shutter part 3 to the covering 5 now have acute angles. The other two legs of the second corners, which are movably connected to the connecting rail, now have obtuse angles. At the beginning of the sliding motion, the bolts are moved, in the inclined paths of the oblong slots 13, in the direction of the ends of the oblong slots 13 that are located closest to the axis of rotation D. These ends are located in the direction of the side of the locking bar 10 that faces away from the covering 5, as a result of which the locking bar 10 is moved away from the shutter parts 2 and 3, and as a result of which the second end of the locking bar 10 is moved out of the locking element 11.

FIGS. 8*a* and 8*b* show the further course of the sliding procedure. Upon reaching the terminal position of the sliding procedure, the end of the locking bar 10 located closest to the axis of rotation D is locked by a guiding terminal-position keeper 12, as a result of which the first shutter part 3 is kept parallel over the second shutter part 2. The guiding terminal-position keeper 12 can be based on a magnetic and/or mechanical principle of operation. Sliding the first shutter part 3 back into its position located next to the second shutter part 2 is first accomplished by undoing the locking counter to the magnetic and/or mechanical holding force of the guiding terminal-position keeper 12 and by then sliding it further as far as the lateral end position of the shutter part 3 and pressing on the shutter part 3, as a result of which that shutter part is brought next to the shutter part 2. The outward thrusting mechanism 4 is in the process locked on the covering 5 again, and the two latching mechanisms described above lock the two shutter parts 2 and 3.

FIGS. 9*a* through 9*c* again in detail show the function of the first latching mechanism. In FIG. 9*a*, the end of the connecting rail 9 is located next to the first end of the locking bar 10, as a result of which the shutter parts 2 and 3 are locked next to one another. In FIG. 9*b*, the first shutter part 3 is shifted into a plane that is parallel to the second shutter part 2, as a result of which the end of the connecting rail 9 is located behind the first end of the locking bar 10, and as a result, a first lateral sliding of the shutter parts 2 and 3 relative to one another is made possible. In FIG. 9*c*, the first lateral sliding is performed, and the end of the connecting rail 9 is now located directly behind the first end of the locking bar 10, and as a result a parallel reverse shifting of the shutter part 3 into the plane of the shutter part 2 is prevented.

FIGS. 10*a* through 10*c* again show in detail the function of the second latching mechanism. In FIG. 10*a*, the shutter parts 2 and 3 are located next to one another. In this position, bolts, not shown, which are located on the part of the inner guide rail 6 and/or of the covering 5 located farthest away from the axis of rotation D, on the end of the oblong slots 13 located farthest away from the axis of rotation D, and engage these oblong slots. Since the inclined paths of the oblong slots 13 at this site are located in the direction of the side of the shutter parts 2 and 3 oriented toward the covering 5, the locking bar 10 is moved in the direction of the shutter parts 2 and 3, and the second end of the locking bar 10, with a region 14 that is at an angle of 90° and protrudes past the locking bar 10, engages a locking element 11 that is secured to the inner side of the second shutter part 2. FIG. 10*b* shows the situation at the end of the first lateral sliding procedure, in which the bolts have moved along the inclined paths of the oblong slots 13 to the end of the oblong slots 13, which are located closest to the axis of rotation D, as a result of which the angled region 14 is moved out of the locking element 11 and enables a further sliding of the first shutter part 3 over the second shutter part 2, as is shown in FIG. 10*c*.

The invention claimed is:

1. A shutter (1) for furniture, cabinets, and shelf units, comprising at least two shutter parts (2, 3) arranged next to one another in a common plane, the shutter parts pivoted on a furniture carcass about an axis of rotation; the shutter parts (2, 3) are guided movably relative to one another an inner guide located on inner sides thereof oriented toward the furniture carcass, such that the shutter parts can be shifted out of the common plane into two mutually parallel planes, and then displaced one in front of the other;

wherein a first shutter part (3), located the farthest away from the axis of rotation, cooperates with a second shutter part (2) located closer to the axis of rotation, by at least two guides (6) of the inner guide that are located on the inner sides of the shutter parts; and an outward thrusting mechanism (7) cooperates with the first shutter part (3), the outward thrusting mechanism (7) is movable out of an inoperative position into an operative position, such that the first shutter (3) can be moved out of the common plane and into one of the two mutually parallel planes.

2. The shutter (1) of claim 1, characterized in that next, the first shutter part (3) can be slid over the second shutter part (2) by the guides (6).

3. The shutter (1) of one of the foregoing claims, characterized in that the outward thrusting mechanism (7) and the guides (6) are connected at least partially to a covering (5) on inner sides thereof oriented toward the furniture carcass.

4. The shutter (1) of claim 1, characterized in that the guides (6) consist of an inner guide rail (6).

5. The shutter (1) of claim 1, characterized in that in the inoperative position of the outward thrusting mechanism (7), the shutter parts (2, 3) are locked by a first and second latching mechanism in their positions located next to one another;

in the operative position of the outward thrusting mechanism (7), the shutter parts (2, 3) firmly retain their parallel planes by the first latching mechanism; and the shutter parts (2, 3) can be slid in their positions relative to one another.

6. The shutter (1) of claim 1, characterized in that the outward thrusting mechanism (7) is located between the guides (6) that are farthest away from one another, on the end of the guides remote from the axis of rotation;

the first shutter part (3) or the outward thrusting mechanism (7) has an outward thrusting mechanism (4), which cooperates with a covering (5); and the outward thrusting mechanism (4) retains the outward thrusting mechanism (7) in the inoperative position, or enables a movement into the operative position.

7. The shutter (1) of claim 6, characterized in that the outward thrusting mechanism (4) operates in spring-loaded fashion; and the outward thrusting mechanism (4) is lockable on the covering (5) and/or is braced thereon.

8. The shutter (1) of claim 6, characterized in that the outward thrusting mechanism (4) has a slide in/out mechanism that is latchable.

9. The shutter (1) of claim 1, characterized in that the outward thrusting mechanism (7) has a connecting rail (9), which extends on at least one of its ends as far as the guides (6) and which cooperates with at least two connecting parts (8) that are movable in parallelogram fashion;

opposed first corners of the connecting parts (8) are connected to the first shutter part (3) and a covering (5);

opposed second corners of the connecting parts (8) are movably connected to the connecting rail (9);

in the inoperative position of the outward thrusting mechanism (7), the connecting parts (8) have two obtuse and two acute angles, and the first corners have the obtuse angles; and in the operative position of the outward thrusting mechanism (7), the angle pairs each assume the other angular position.

10. The shutter (1) of claim 1, characterized in that the guides (6) are in at least three parts;

the parts are connected to one another in such a way that they can be pulled apart;

the part located closest to the axis of rotation is connected to the second shutter part (2);

the part farthest away from the axis of rotation is connected to a covering (5); and at least one locking bar (10) is connected to the part farthest away from the axis of rotation and/or to the covering (5) via two oblong slots (13), located parallel to the guides (6) and/or covering (5) and inclined in their path, on the respective end of the locking bar (10), and via two bolts, located on the farthest-away part and/or on the covering (5), which bolts engage the oblong slots (13).

11. The shutter (1) of claim 10,
characterized in that with shutter parts (2, 3) located side by side, the end of the locking bar (10) located farthest away from the axis of rotation is located next to the end of the connecting rail (9), which end extends as far as the guides (6);

the end of the locking bar (10) located closest to the axis of rotation, which locking bar has a region (14) angled by 90° and protruding past the locking bar (10), and with this region that end of the locking bar engages a locking element (11) located on the inner side of the second shutter (2);

by the motion of the outward thrusting mechanism (7) out of the inoperative position into the operative position and subsequent sliding of the first shutter part (3) over the second shutter part (2), first one end of the connecting rail (9) is moved behind the end, located farthest away from the axis of rotation, of the locking bar (10), and by the motion of the bolts into the oblong slots (13) of the angled region (14) is moved out of the locking element (11); and when the first shutter part (3) cannot be slid further, the end of the locking bar (10) located closest to the axis of rotation is locked by a guiding terminal-position keeper (12).

12. The shutter (1) of claim 11,
characterized in that the guiding terminal-position keeper (12) is based on a magnetic and/or mechanical operating principle.

* * * * *